US007815365B2

(12) United States Patent
Hiranuma et al.

(10) Patent No.: US 7,815,365 B2
(45) Date of Patent: Oct. 19, 2010

(54) PORTABLE TIMEPIECE

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 138 days.

(21) Appl. No.: 12/313,470

(22) Filed: Nov. 20, 2008

(65) Prior Publication Data

US 2009/0135682 A1 May 28, 2009

(30) Foreign Application Priority Data

Nov. 26, 2007 (JP) ..... 2007-304797

(51) Int. Cl.
*G04B 37/00* (2006.01)

(52) U.S. Cl. ..... 368/319; 368/288; 368/289; 368/308

(58) Field of Classification Search ..... 368/288, 368/289, 290, 308, 319, 320, 321
See application file for complete search history.

(56) References Cited

U.S. PATENT DOCUMENTS

2002/0167866 A1* 11/2002 Oomori et al. ..... 368/191
2004/0257917 A1* 12/2004 Yoshikawa ..... 368/318
2005/0094498 A1* 5/2005 Koshoji et al. ..... 368/319
2006/0187766 A1* 8/2006 Hiranuma et al. ..... 368/319

FOREIGN PATENT DOCUMENTS

JP 57046181 3/1982

* cited by examiner

*Primary Examiner*—Vit W Miska
*Assistant Examiner*—Jason Collins
(74) *Attorney, Agent, or Firm*—Adams & Wilks

(57) ABSTRACT

A diver's watch includes a timepiece exterior assembly including a movement, a hand setting stem pipe, a crown for operating the movement, and a cover pipe. A locking face is formed at an outer peripheral portion of a case body provided to the timepiece exterior assembly. The hand setting stem pipe is fixed to the case body and includes a pipe side screw portion. The crown includes a crown cylinder inserted to inside of the hand setting stem pipe, and a crown head integral with the crown cylinder. The crown head is formed with a crown side screw portion attachably and detachably screwed to the pipe side screw portion, and an engaging end face brought into contact with and separated from the locking face. The cover pipe is arranged to be more proximate to the crown cylinder than the engaging end face. Thereby, the hand setting stem pipe is covered by the cover pipe and the covered state is maintained regardless of a movement in an axial direction of the crown.

5 Claims, 9 Drawing Sheets

PORTABLE TIMEPIECE

BACKGROUND OF THE INVENTION

The present invention relates to a portable timepiece of a diver's watch or the like including a crown locked so as not to be rotated unpreparedly.

In a background art, there is known a timepiece capable of locking a crown so as not to be rotated unpreparedly (refer to, for example, Patent References 1, 2).

According to a timepiece of Patent Reference 1, a hand setting stem pipe is formed by a small diameter portion and a large diameter portion and the small diameter portion is fixed to a through hole of a case body. The large diameter portion of the hand setting stem pipe is projected to an outer side of the case body and an outer periphery thereof is formed with a screw portion. Further, a crown is formed by an outer cylinder member an inner face of which is formed with a screw portion, and an inner cylinder member which is formed with a center hole on which a crown core slides and an outer periphery of which is attached with a waterproof packing, and by inserting the inner cylinder member to the hand setting stem pipe from an outer side of the case body, waterproof between the hand setting stem pipe and the inner cylinder member is ensured. The crown is locked by the hand setting stem pipe by screwing the screw portion of the inner cylinder member to the screw portion of the hand setting stem pipe (bringing in mesh therewith).

Although a portable timepiece of Patent Reference 2 is similar to the timepiece of Patent Reference 1, by bringing a screw portion formed at a crown in mesh with a screw portion formed at an outer periphery of a large diameter portion of a hand setting stem pipe and bringing an end face on a back side of the crown opposed to the case body into contact with an outer face of the case body, the crown is held so as not to be rotated unpreparedly.

[Patent Reference 1] JP-UM-A-7-26792 (paragraphs 0001, 0009-0011, FIG. 1-FIG. 2)

[Patent Reference 2] JP-A-57-461281 (column of detailed description of invention, FIG. 1-FIG. 2)

SUMMARY OF THE INVENTION

As is well known, time is set or date is set by operating to rotate a hand setting stem by way of a crown in a state of drawing the crown in a direction of being remote from a case body by the hand and the finger after disengaging a screw portion from being brought in mesh therewith. According to timepieces of Patent Reference 1, 2 in which crowns are locked by screwing screw portions, in accordance with drawing the crown, the more remote the crown from the case body, the more exposed the screw portion of the hand setting stem pipe.

Meanwhile, time of a diver's watch is frequently set at seashore, and therefore, in this case, the hand of a diver operating the timepiece is wet, and sand or the like may be adhered to the hand. When time is set under such a situation, in the timepieces of Patent References 1, 2, there is a high possibility of adhering a small foreign matter of sand or the like to the exposed screw portion.

When the screw portion of the crown is screwed to the screw portion of the hand setting stem pipe while the foreign matter of sand or the like is adhered to the screw portion, the foreign matter of sand or the like is bit in. Therefore, rotation of the crown for screwing or releasing screwing becomes unsmooth, operational feeling is deteriorated and the screw portion may be damaged.

It is an object of the invention to provide a portable timepiece capable of restraining a foreign matter of sand or the like from being brought to a screw portion of locking a crown such that the crown is not rotated unpreparedly.

A portable timepiece of the invention is characterized in including a timepiece exterior assembly having a case body an outer peripheral portion of which is formed with a locking face and including a movement, a hand setting stem pipe having a pipe side screw portion and fixed to the case body, a crown having a crown cylinder inserted to inside of the hand setting stem pipe and a crown head integral with the crown cylinder and formed with a crown side screw portion attachably and detachably screwed to the pipe side screw portion, and an engaging end face brought into contact with and separated from the locking face at the crown head for operating the movement, and a cover pipe arranged more proximate to the crown cylinder than the engaging end face, covering the hand setting stem pipe and maintaining the covered state regardless of a movement in an axial direction of the crown.

The portable timepiece of the invention includes the cover pipe covering the outer periphery of the hand setting stem pipe, even in a state in which the crown is separated from the locking face of the case body to be able to operate to rotate the crown, the cover pipe maintains a state of covering the hand setting stem pipe such that the hand setting stem pipe is not exposed to between the locking face of the case body and the engaging end face of the crown. Therefore, when the crown is operated to set time or the like including an operation of releasing the pipe side screw portion and the crown side screw portion from being brought in mesh with each other, a foreign matter of sand or the like can be restrained from being brought to screw portions on a side of the pipe and on a side of the crown by the cover pipe.

A preferable embodiment of the portable timepiece of the invention is characterized in that the case body is formed with a recess portion containing the hand setting stem pipe, the locking face is continuous to an opening end of the recess portion, the cover pipe is a part separate from the crown and contained in the recess portion, further, the cover pipe includes a spring receive at an inner periphery thereof, and a coil spring for pressing the cover pipe to the crown is provided between the spring receive and a depth face of the recess portion.

According to the preferable embodiment, the cover pipe is moved by following drawing of the crown by a force of the coil spring when the crown side screw portion is released from being brought in mesh with the pipe side screw portion, and when the crown is drawn successive thereto. Thereby, even in a state in which the crown is separated from the locking face of the case body to be able to operate to rotate the crown, the cover pipe is maintained in a state of covering the outer periphery of the hand setting stem pipe such that the hand setting stem pipe is not exposed to between the locking face of the case body and the engaging end face of the crown. Therefore, when the crown is operated to set time or the like including an operation of releasing the pipe side screw portion and the crown side screw portion from being brought in mesh with each other, a foreign matter of sand or the like can be restrained from being brought to the screw portions on the side of the pipe and on the side of the crown by the cover pipe.

Other preferable embodiment of the portable timepiece of the invention is characterized in that the crown head is formed with a pipe containing portion opened to a side of the case body, the cover pipe is contained in the pipe containing portion, the cover pipe includes a spring receive, and a coil spring for pressing the cover pipe to the locking face is provided between the spring receive and a depth face of the pipe containing portion.

According to the other preferable embodiment, the cover pipe is maintained to be brought into contact with the locking face of the case body by the force of the coil spring even when the crown side screw portion is released from being brought in mesh with the pipe side screw portion, and even when the crown is drawn successive thereto. In other words, relatively, simultaneous with the movement in the direction of drawing the crown, the cover pipe is moved to the locking face of the case body. Thereby, the state of covering the outer periphery of the hand setting stem pipe by the cover pipe is maintained such that the hand setting stem pipe is not exposed to between the locking face of the case body and the engaging end face of the crown even in a state in which the crown is separated from the locking face of the case body to be able to operate to rotate the crown. Therefore, when the crown is operated to set time or the like including the operation of releasing the pipe side screw portion and the crown side screw portion from being brought in mesh with each other, a foreign matter of sand or the like can be restrained from being brought to the screw portions on the side of the pipe and on the side of the crown by the cover pipe.

Further, a still other preferable embodiment of the portable timepiece of the invention is characterized in that the case body is formed with a recess portion containing the hand setting stem pipe, the locking face is continuous to an opening end of the recess portion, and the cover pipe is formed integrally with the crown head and inserted to the recess portion.

According to the still other preferable embodiment, when the crown side screw portion is released from being brought in mesh with the pipe side screw portion and when the crown is drawn successive thereto, the cover pipe is moved integral with the crown in accordance therewith. Thereby, the cover pipe is maintained in the state of covering the outer periphery of the hand setting stem pipe such that the hand setting stem pipe is not exposed to between the locking face of the case body and the engaging end face of the crown even in a state in which the crown is separated from the locking face of the case body to be able to operate to rotate the crown. Therefore, when the crown is operated to set time or the like including the operation of releasing the pipe side screw portion and the crown side screw portion from being brought in mesh with each other, a foreign matter of sand or the like can be restrained from being brought to the screw portions on the side of the pipe and on the side of the crown by the cover pipe.

Further, a preferable embodiment of the portable timepiece of the invention is characterized in that the pipe side screw portion is formed by a male screw portion, and the pipe side screw portion is disposed to project to an outer side of the case body relative to the locking face.

According to the preferable embodiment, in operating the crown to set time or the like, when an operation of releasing the pipe side screw portion and the crown side screw portion from being screwed, even when the nail of the hand of a user is long, the nail tip can be prevented from being caught by the pipe side screw portion constituted by the male screw by the cover pipe, and therefor, the crown is easy to be disengaged from the hand setting stem pipe.

According to the portable timepiece of the invention, there is achieved an effect of capable of restraining a foreign matter of sand or the like from being brought to the screw portion for locking the crown such that the crown is not unpreparedly rotated.

DETAILED DESCRIPTION OF THE PREFERRED EMBODIMENT

A first embodiment of the invention will be explained in reference to FIG. 1 through FIG. 4.

Figure 1:
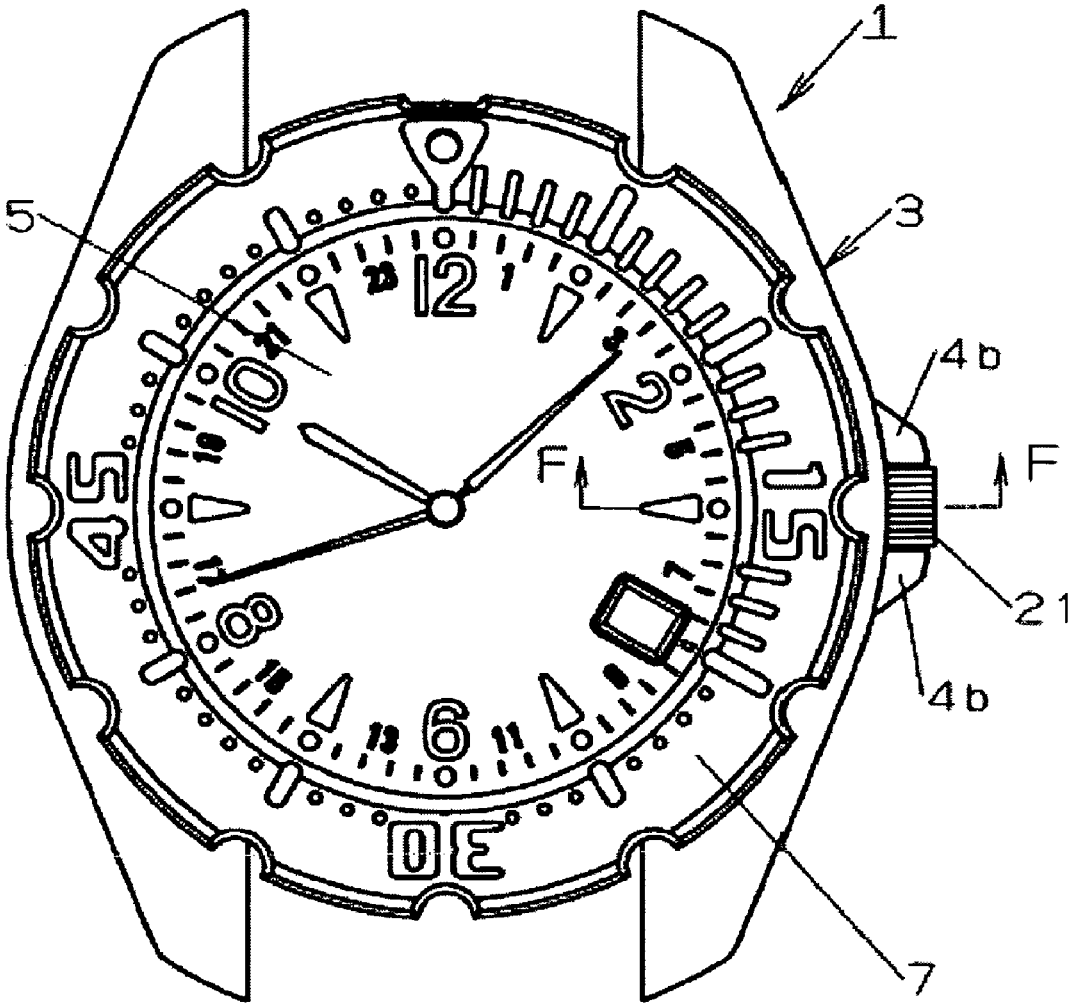
FIG. 1 is a front view showing a diver's watch according to a first embodiment of the invention.

Notation 1 in FIG. 1 designates a portable timepiece, for example, a diver swatch used by being attached to the wrist of the human body. The diver's watch 1 includes a timepiece exterior assembly 3 including a movement 2 (refer to FIG. 2 through FIG. 4) or the like.

As shown by FIG. 1 through FIG. 4, the timepiece exterior assembly 3 is formed by mounting a cover glass 5 to a front face of a case body 4 made of a metal constituting a ring-like shape in liquid tight and mounting a case back 6 to a back face of the case body 4 in liquid tight. Time display of the movement 2 or the like can be seen through the cover glass 5, and the case back 6 is removable. A rotating bezel 7 in a ring shape is rotatably attached to the case body 4 by surrounding a surrounding of the cover glass 5.

Figure 2:
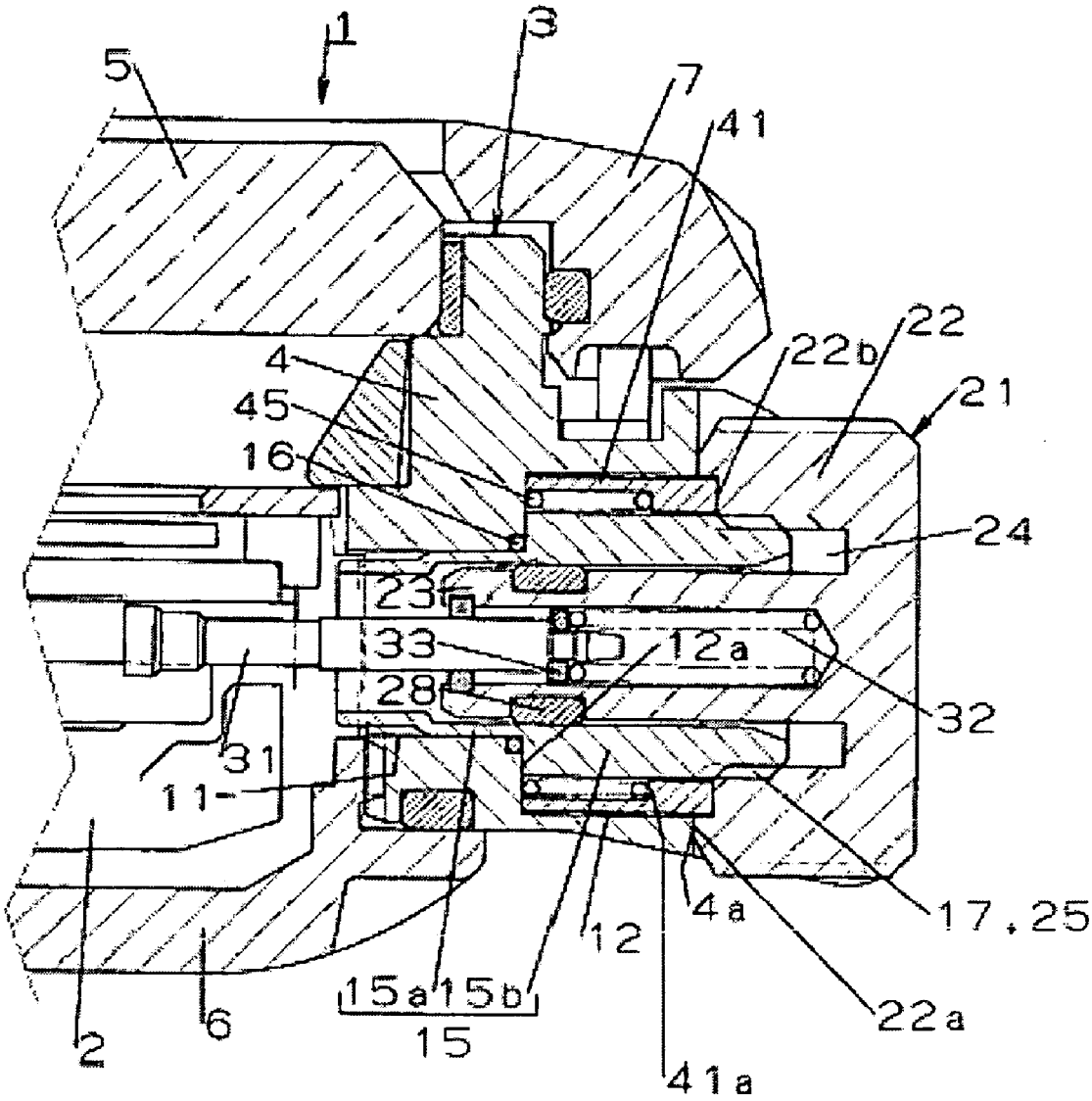
FIG. 2 is a sectional view showing a state of locking a crown along a line F-F of FIG. 1.
Figure 3:
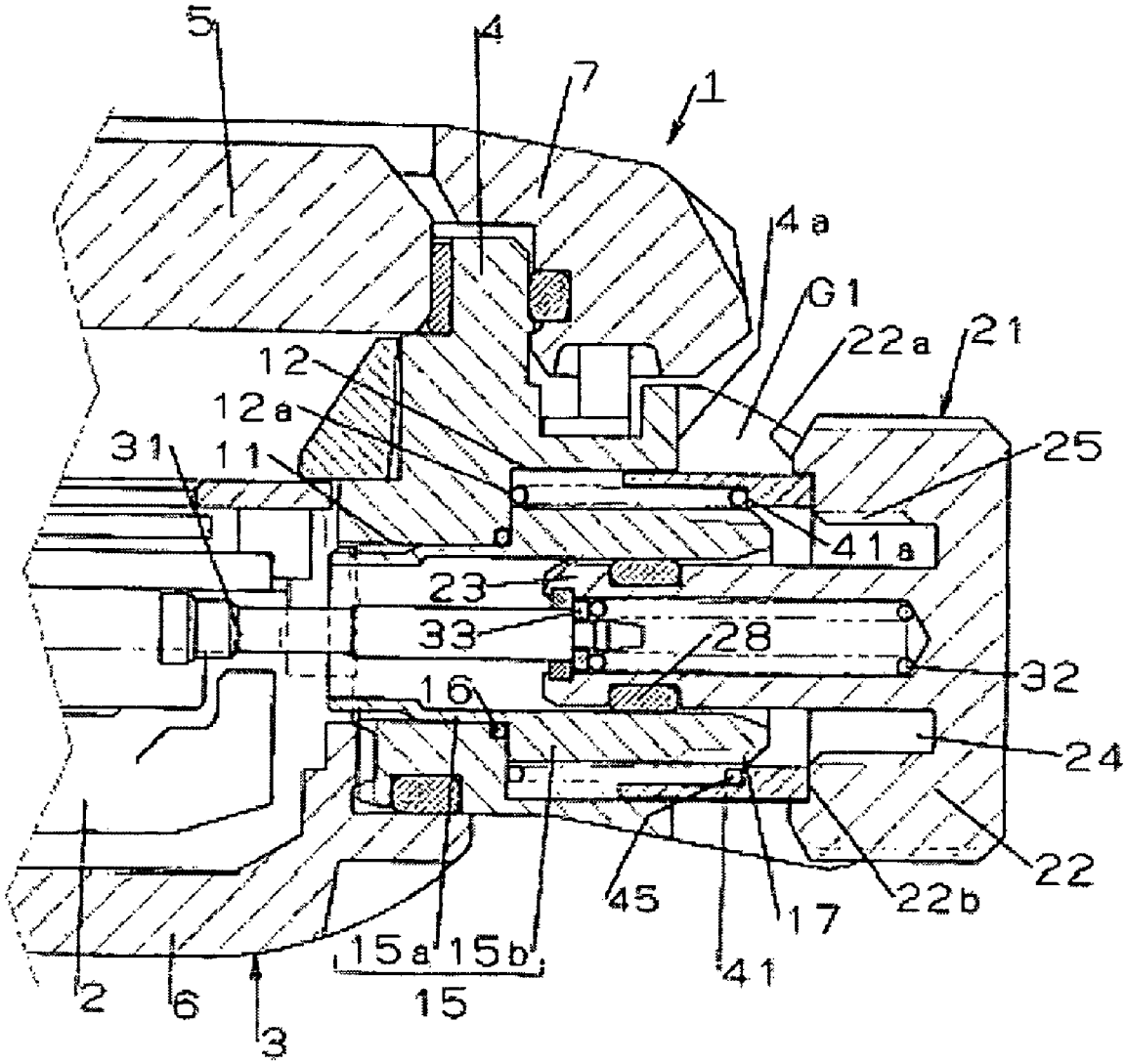
FIG. 3 is a sectional view showing a state of drawing the crown by one stage along the line F-F of FIG. 1.
Figure 4:
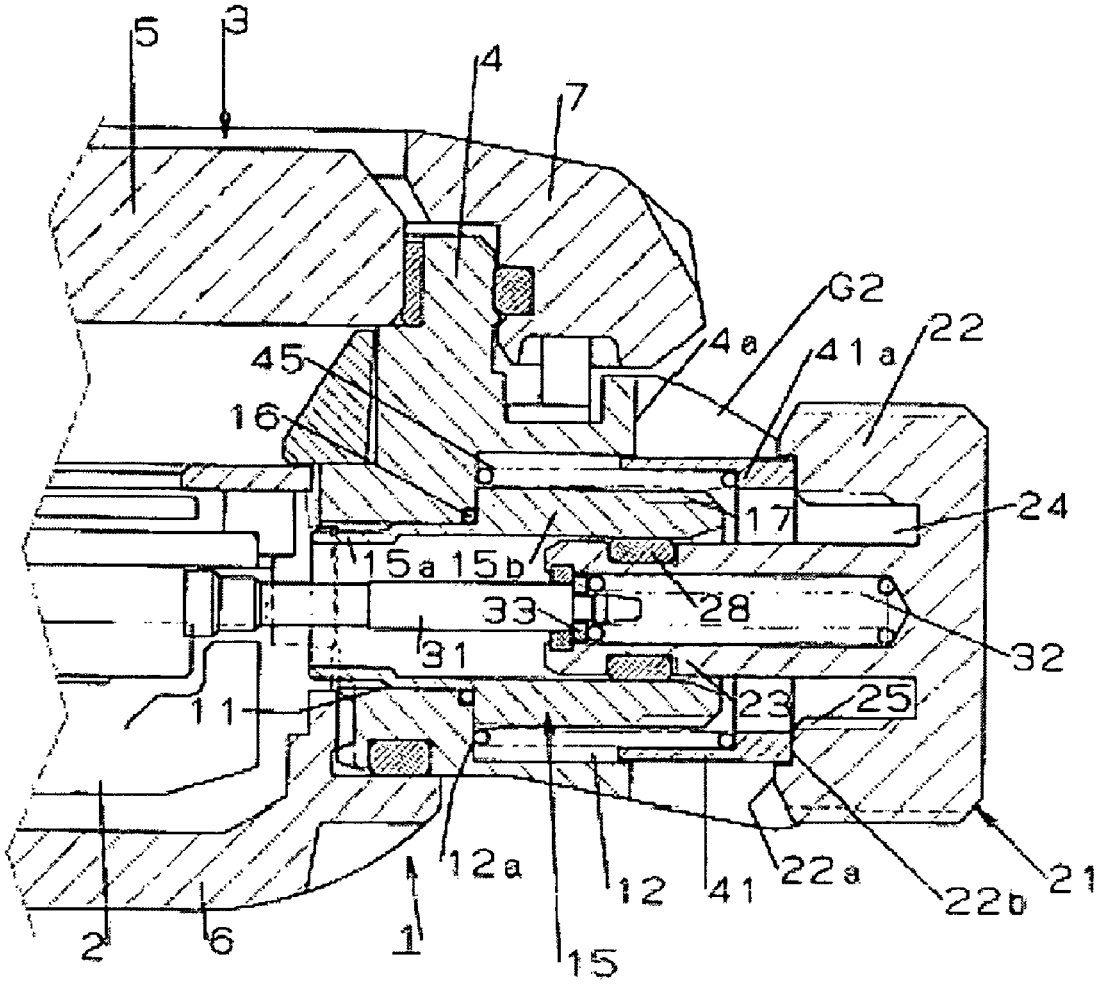
FIG. 4 is a sectional view showing a state of drawing the crown by two stages along the line F-F of FIG. 1.

A pipe attaching hole 11 and a recess portion 12 communicated with each other and penetrating the case body 4 in a radius direction are formed at the case body 4 by being disposed, for example, in 3 o'clock direction of a dial as shown by FIG. 2 through FIG. 4. The pipe attaching hole 11 and the recess portion 12 are provided to align in the radius direction of the case body 4 to be continuous by constituting center axis lines thereof (not illustrated) by a straight line. Both of the pipe attaching hole 11 and the recess portion 12 are constituted by circular holes and a diameter of the recess portion 12 is larger.

The pipe attaching hole 11 is formed by being more proximate to an inner portion of the case body 4 (case body inner face) than the recess portion 12 and is opened to the case body inner space. The recess portion 12 is formed more proximate to an outer side of the case body 4 than the pipe attaching hole 11 and is opened to a locking face 4*a* formed at an outer peripheral portion of the case body 4. Therefore, the locking face 4*a* is continuous to an open end of a case body outer side of the recess portion 12, and the locking face 4*a* is orthogonal to an inner peripheral face of the recess portion 12.

As shown by FIG. 2 through FIG. 4, a hand setting stem pipe 15 made of a metal, for example, made of stainless steel is fixed to the case body 4. That is, the hand setting stem pipe 15 is constituted by a small diameter portion 15*a* in a circular cylinder shape and a large diameter portion 15*b* similarly in a circular cylinder shape. An outer diameter of the large diameter portion 15*b* is larger than an outer diameter of the small diameter portion 15*a* and is smaller than the diameter of the recess portion 12. The hand setting stem pipe 15 is fixed by press-fitting the small diameter portion 15*a* to the pipe attaching hole 11 from an outer side of the case body 4 and soldering the hand setting stem pipe 15 to the case body 4. Notation 16 in FIG. 2 through FIG. 4 designates a solder member made of a metal. The solder member 16 fixes the hand setting stem pipe 15 by a corner made by the locking face 4*a* and the inner peripheral face of the recess portion 12, thereby, invasion of water from the fixed portion of the hand setting stem pipe 15 is prevented.

A length of the large diameter portion 15*b* is longer than a depth dimension of the recess portion 12. Therefore, a front end portion of the large diameter portion 15*b* on a side opposed to the small diameter portion 15*a* is extruded from the recess portion 12. In other words, the front end portion of the large diameter portion 15*b* is disposed on an outer side of the case body 4 to project to the outer side of the case body 4 relative to the locking face 4*a*. Further, an outer periphery of the front end portion is provided with a pipe side screw portion 17 for screwing to lock a crown, mentioned later, and the pipe side screw portion 17 is formed by a male screw portion.

A crown 21 made of a metal is supported by the hand setting stem pipe 15 movably in an axial direction thereof (radius direction of case body 4). The crown 21 includes a crown head 22 and a crown cylinder 23 integrally projected from a center portion thereof, and an inner side of the crown head 22 is formed with an escape groove 24 in a shape of a circular ring surrounding a root portion of the crown cylinder 23.

The escape groove 24 is inserted with a front end portion of the large diameter portion 15*b* formed with the pipe side screw portion 17. The crown head 22 is formed with a crown side screw portion 25 for screwing to lock the crown 21 and the crown side screw portion 25 is formed by a female screw portion. The crown side screw portion 25 faces the escape groove 24. The crown side screw portion 25 is attachably and detachably screwed to the pipe side screw portion 17.

A back face (end face on case body side) of the crown head 22 includes an engaging end face 22*a* brought into contact with and separated from the locking face 4*a* in accordance with attaching and detaching the crown 21 to and from the hand setting stem pipe 15. When the crown 21 is viewed from the back side, the engaging end face 22*a* constitutes a ring shape. Further, the crown head 22 includes a recess portion 22*b* having a shallow depth. The recess portion 22*b* is disposed between the crown side screw portion 25 and the engaging end face 22*a*, constitutes a ring shape when the crown 21 is viewed from the back side, and a diameter thereof is equal to a diameter of the recess portion 12. The recess portion 22*b* is surrounded by the engaging end face 22*a* and the crown side screw portion 25 is continuous to the recess portion 22*b*.

The crown cylinder 23 of the crown 21 is formed with a packing attaching groove opened to an outer periphery thereof, and a waterproof packing 28 in a ring shape is mounted by being fitted to the packing attaching groove. The waterproof packing 28 is constituted by an elastic material of rubber, elastomer or the like. The crown cylinder 23 is inserted to the hand setting stem pipe 15 from a case body outer side movably in an axial direction thereof. Thereby, the waterproof packing 28 is elastically deformed to be pinched between an inner peripheral face of the hand setting stem pipe 15 and the crown cylinder 23 in a compressed state to carry waterproof therebetween.

Inside of the crown cylinder 23 is inserted with a hand setting stem 31 from a case body inner side and contains a hand setting stem urging spring 32. The hand setting stem 31 is connected to the movement 2. The hand setting stem urging spring 32 is pinched between a spring receive ring 33 attached to a front end portion of the hand setting stem 31 and a depth end of a hollow portion of the crown cylinder 23 in a compressed state and urges the hand setting stem 31 to the movement 2 in an axial direction.

The hand setting stem 31 is rotated cooperatively with an operation of rotating the crown 21 to transmit a movement thereof to the movement 2 in a state of releasing the pipe side screw portion 17 and the crown side screw portion 25 from being brought in mesh with each other, in other words, in a state of releasing the crown 21 from being screwed to lock as shown by FIG. 3 and FIG. 4. Thereby, for example, date is set by operating to rotate the crown 21 in a state of drawing the crown 21 by a constant dimension as shown by FIG. 3 (the state is referred to as the crown 21 is drawn by one stage), and, for example, time is set by operating to rotate the crown 21 in a state of further drawing the crown 21 by a constant dimension by constituting a reference by the one stage (the state is referred to as the crown 21 is drawn by two stages).

A cover pipe 41 in a shape of a circular cylinder both ends of which are opened is contained in a space of a shape of a circular ring formed between an inner peripheral face of the recess portion 12 and an outer peripheral face of the large diameter portion 15*b* of the hand setting stem pipe 15 movably along the inner peripheral face of the recess portion 12 and one end portion of the cover pipe 41 is fitted to the recess portion 22*b*. Therefore, a diameter of the cover pipe 41 is smaller than that of the engaging end face 22*a* and is arranged to be proximate to a side of the crown cylinder 23 more than the engaging end face 22*a*.

The cover pipe 41 covering the large diameter portion 15*b* includes a spring receive 41*a* constituted by a stepped portion in a ring shape at an inner periphery thereof. A coil spring 45 covered by the cover pipe 41 is contained in the space in the circular ring shape. The coil spring 45 is pinched in a compressed state between a depth face 12*a* of the recess portion 12 supporting one end thereof and the spring receive 41*a* supporting other end thereof and presses the cover pipe 41 to the crown 21. A spring force of the coil spring 45 is smaller than a spring force of the hand setting stem urging spring 32.

The cover pipe 41 is provided with a length capable of maintaining a state of being inserted to the recess portion 12 even when the crown 21 is maximally drawn out, according to the embodiment, even when the crown 21 is arranged at two stages drawing position as shown by FIG. 4. Specifically, the cover pipe 41 is provided with a length pinched by a back face of the crown 21 screwed to lock and the depth face 12*a* of the recess portion 12 as shown by FIG. 2. Further, according to the embodiment, as described above, the crown 21 is provided with the recess portion 22*b*, and therefore, the length of the cover pipe 41 is set to a length longer than the depth of the recess portion 12 and in correspondence with a dimension of adding the depth of the recess portion 22*b* to the depth of the recess portion 12.

According to a constitution in which the cover pipe 41 is a part separate from the crown 21 and is not connected to the crown 21 as in the embodiment, a material constituting the cover pipe 41 is not restricted by a material constituting the crown 21 and various metal materials or synthetic resin materials can be selected. Therefore, as a material constituting the cover pipe 41, a material having a small sliding resistance and easy to move with regard to the inner peripheral face of the recess portion 12 or the like, a metal material or the like having a high strength can be adopted and a material or the like having an elasticity can also be adopted. When the cover pipe 41 is formed by a synthetic resin material having an elasticity, the cover pipe 41 is elastically deformed to compress in an axial direction in a state of locking to screw the crown 21 as shown by FIG. 2 to be able to function as a packing, and therefore, a waterproof function around the crown in the state of locking to screw can further be promoted.

Further, notation 4*b* in FIG. 1 designates a pair of guard projected portions integrally formed with the case body 4, and the guard projected portions 4*b* are provided contiguously to the crown 21 from 12 o'clock-6 o'clock direction of the timepiece. Although the pair of guard projected portions 4*b* permit respective operations of drawing and pushing and rotating the crown 21, the pair of guard projected portions 4*b* hamper an unprepared crown operation from 12 o'clock-6 o'clock direction.

A state in which the crown 21 is screw-locked is shown in FIG. 2. Under the state, the crown side screw portion 25 of the crown 21 is screwed (brought in mesh with) the pipe side screw portion 17 of the hand setting stem pipe 15, and the engaging end face 22*a* of the crown 21 is brought into close contact with the locking face 4*a* of the case body 4. Thereby, the crown 21 is maintained in a screw-locked state.

Further, the cover pipe 41 is pressed to inside of the recess portion 12 of the case body 4 against the coil spring 45, and the cover pipe 41 is pinched by the depth face 12*a* of the recess portion 12 and the depth face of the recess portion 22*b*. Under the state, although the cover pipe 41 shorter than the large diameter portion 15*b* of the hand setting stem pipe 15 does not cover the pipe side screw portion 17, by bringing the engaging end face 22*a* and the locking face 4*a* into close contact with each other as described above, sand and dust or the like is prevented from invading the hand setting stem pipe 15.

When, for example, date is set by operating the crown 21, date is set first, by rotating the crown 21 in a direction of releasing the crown side screw portion 25 from being brought in mesh with the pipe side screw portion 17 to release the mesh, successively, operating to draw the crown 21 to one stage drawing position in a direction of being remote from the case body 4 along the axial direction, thereafter, operating to rotate the crown 21. The state is shown in FIG. 3.

When date is set, the crown 21 is separated from the case body 4 as shown by FIG. 3 by operating to draw the crown 21 to the one stage drawing position and a gap G1 is produced between the locking face 4*a* of the case body 4 and the engaging end face 22*a* of the crown 21.

However, as the crown 21 is being remote from the case body 4 by the above-described operation, the cover pipe 41 is moved by the spring force of the coil spring 45 by following the moving crown 21, and an amount of projecting the cover pipe 41 from the recess portion 12 is increased.

Thereby, a state in which the cover pipe 41 is arranged over the back face of the crown head 22 and the recess portion 12 is maintained. In other words, the hand setting stem pipe 15 is covered by the cover pipe 41, accurately, a state in which the large diameter portion 15*b* formed with the pipe side screw portion 17 is covered by the cover pipe 41 is continued. Therefore, the pipe side screw portion 17 of the large diameter portion 15*b* is not exposed to the gap G1.

Therefore, when time is set as described above under a condition of a large amount of a foreign matter of dust and dirt or the like as in seashore, the foreign matter of sand or the like can be restrained from being brought to the pipe side screw portion 17 and the crown side screw portion 25 by passing the gap G1 by the cover pipe 41.

When, for example, time is set by operating the crown 21 further from the state of FIG. 2, time is set by first operating to draw the crown 21 to a two stages drawing position, thereafter, operating to rotate the crown 21. The state is shown in FIG. 4.

When time is set as described above, by operating to draw the crown 21 to the two stages drawing position, as shown by FIG. 4, the crown 21 becomes further remote from the case body 4, and a gap G2 larger than the gap G1 is produced between the locking face 4*a* of the case body 4 and the engaging end face 22*a* of the crown 21. Also in this case, as the crown 21 is being remote the case body 4 similar to the case of one stage drawing explained above, the cover pipe 41 is moved by the spring force of the coil spring 45 by following the crown 21 and the amount of projecting the cover pipe 41 from the recess portion 12 is further increased.

Even when the crown 21 is maximally drawn in this way, the state of arranging the cover pipe 41 over the back face of the crown head 22 and the recess portion 12 is maintained, when the state in which the large diameter portion 15*b* of the hand setting stem pipe 15 is covered by the cover pipe 41 is continued. Therefore, the pipe side screw portion 17 of the large diameter portion 15*b* is not exposed to the gap G2.

Therefore, when time is set as described above under a condition of a large amount the foreign matter of dust and dirt or the like as in, for example, seashore, the foreign matter of sand or the like can be restrained from being brought to the pipe side screw portion 17 and the crown side screw portion 25 by passing the gap G2 by the cover pipe 41.

After the above-described adjustment of setting time or setting date, the crown 21 is maintained in the screw-locked state shown in FIG. 2 by screwing the crown side screw portion 25 to the pipe side screw portion 17 in accordance with pressing the crown 21 to the locking face 4*a* and thereafter operating to rotate the crown 21.

Therefore, when the crown 21 is brought to the screw-locked state after the above-described adjustment, and in the crown operation thereafter, the foreign matter of sand or the like is not bit to between the pipe side screw portion 17 and the crown side screw portion 25. Therefore, the crown 21 is rotated smoothly for screwing the crown 21 to the hand setting stem pipe 15 and releasing the crown 21 from being screwed to the hand setting stem pipe 15, and excellent operating feeling can be achieved.

Further, although the front end portion of the large diameter portion 15*b* of the hand setting stem pipe 15 is provided to project to the case body outer side relative to the locking face 4*a*, and the outer periphery is provided with the pipe side screw portion 17 constituted by the male screw portion, the pipe side screw portion 17 is covered by the cover pipe 41 and is not exposed to between the locking face 4*a* and the engaging end face 22*a* by being covered by the cover pipe 41 even when the crown 21 is drawn to one stage or two stages drawing position as described above. Therefore, when a user is going to draw to move the crown 21 by using the nail of the hand finger, the crown 21 can smoothly be drawn without hampering the operation of drawing the crown 21 by catching the nail tip by the pipe side screw portion 17.

Further, according to the embodiment, the cover pipe 41 is fitted to the recess portion 22*b* of the crown 21, and therefore, the cover pipe 41 can be prevented from being moved to be more or less inclined to a center axis line (not illustrated) of the crown 21. Thereby, a small gap caused by inclination can be restrained from being formed between the cover pipe 41 and a face of the crown head 22 brought into contact therewith (in the embodiment, the depth face of the recess portion 22*b*). Even when such a gap is assumedly formed, the gap can be prevented from facing the gap G1 or G2 by fitting the cover pipe 41 to the recess portion 22*b*. Therefore, the foreign matter of sand or the like can be prevented from being brought to an inner side of the cover pipe 41 from the cover pipe 41 and the face of the crown head 22 brought into contact therewith.

Further preferably, since a size of sand at seashore is equal to or larger than 0.2 mm, it is preferable to make a maximum fitting gap between an outer periphery of the cover pipe 41 and the recess portion 12 and a peripheral face of the recess portion 22*b* equal to or smaller than 0.15 mm. When the fitting gap is set in this way, sand can firmly be prevented from invading the inner side of the cover pipe 41, and sand can be prevented from being adhered to the pipe side screw portion 17 and the crown side screw portion 25.

Further, according to the embodiment, the cover pipe 41 is a part separate from the crown 21, the cover pipe 41 and the coil spring 45 can easily be attached and detached by removing the crown 21, and therefore, maintenance of the two parts is easy to carry out. Along therewith, it is also excellent that when the cover pipe 41 is accidentally needed to interchange, the cover pipe 41 can be interchanged by itself without being accompanied by the crown 21.

Figure 5:
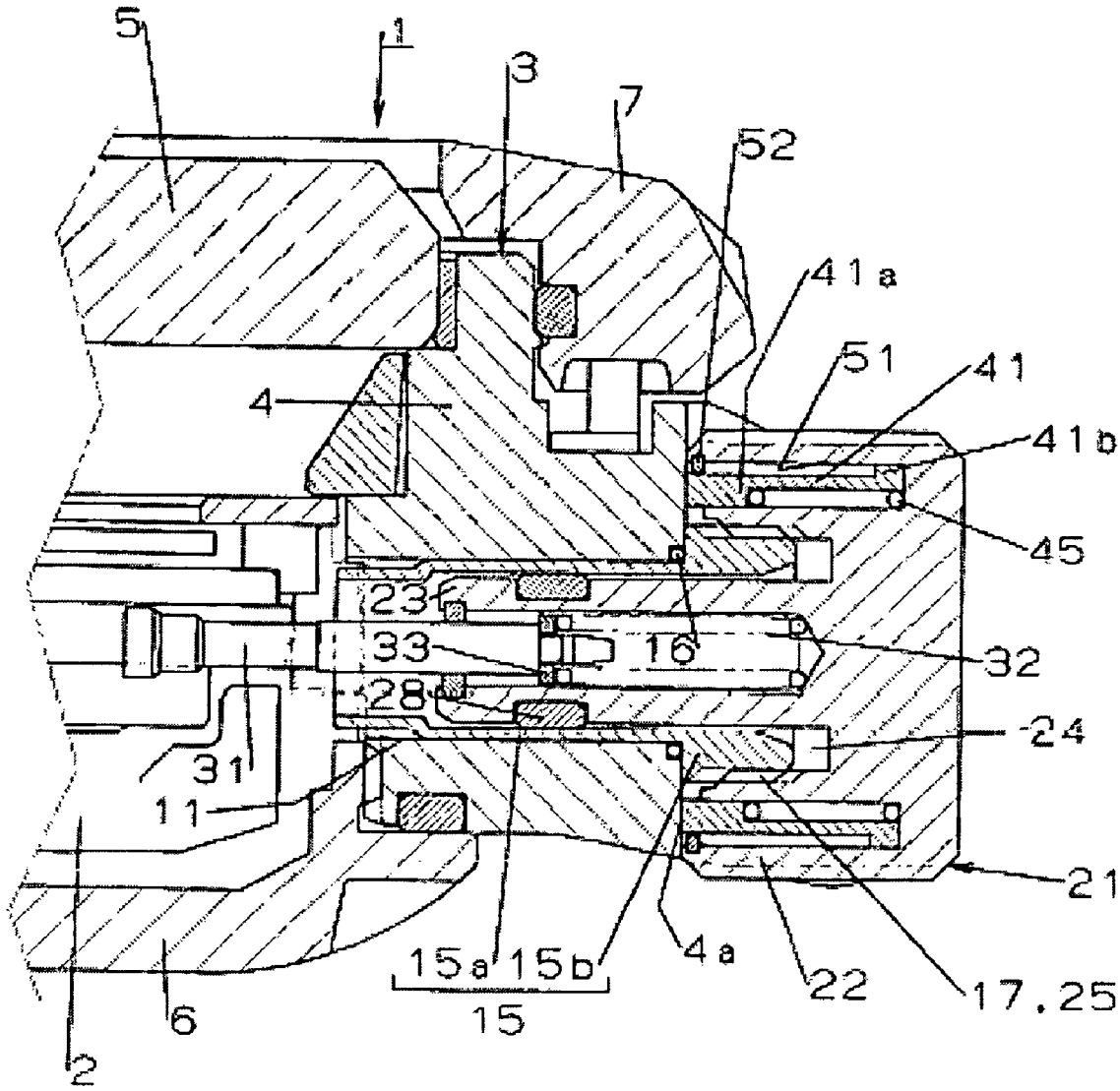
FIG. 5 is a sectional view in correspondence with FIG. 2 showing a state of locking a crown of a diver's watch according to a second embodiment of the invention.
Figure 6:
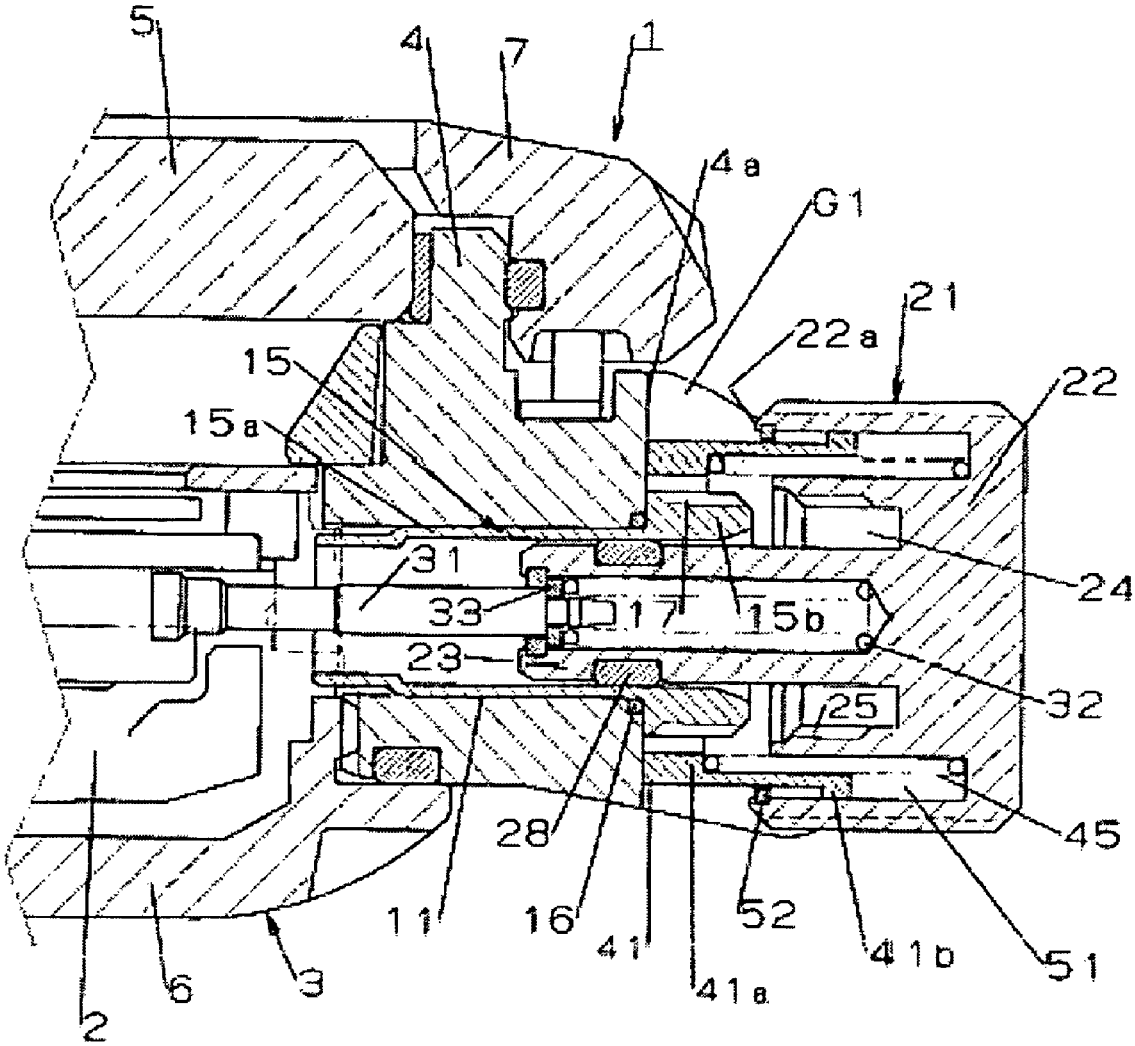
FIG. 6 is s sectional view in correspondence with FIG. 3 showing a state of drawing the crown of the diver's watch according to the second embodiment by one stage.
Figure 7:
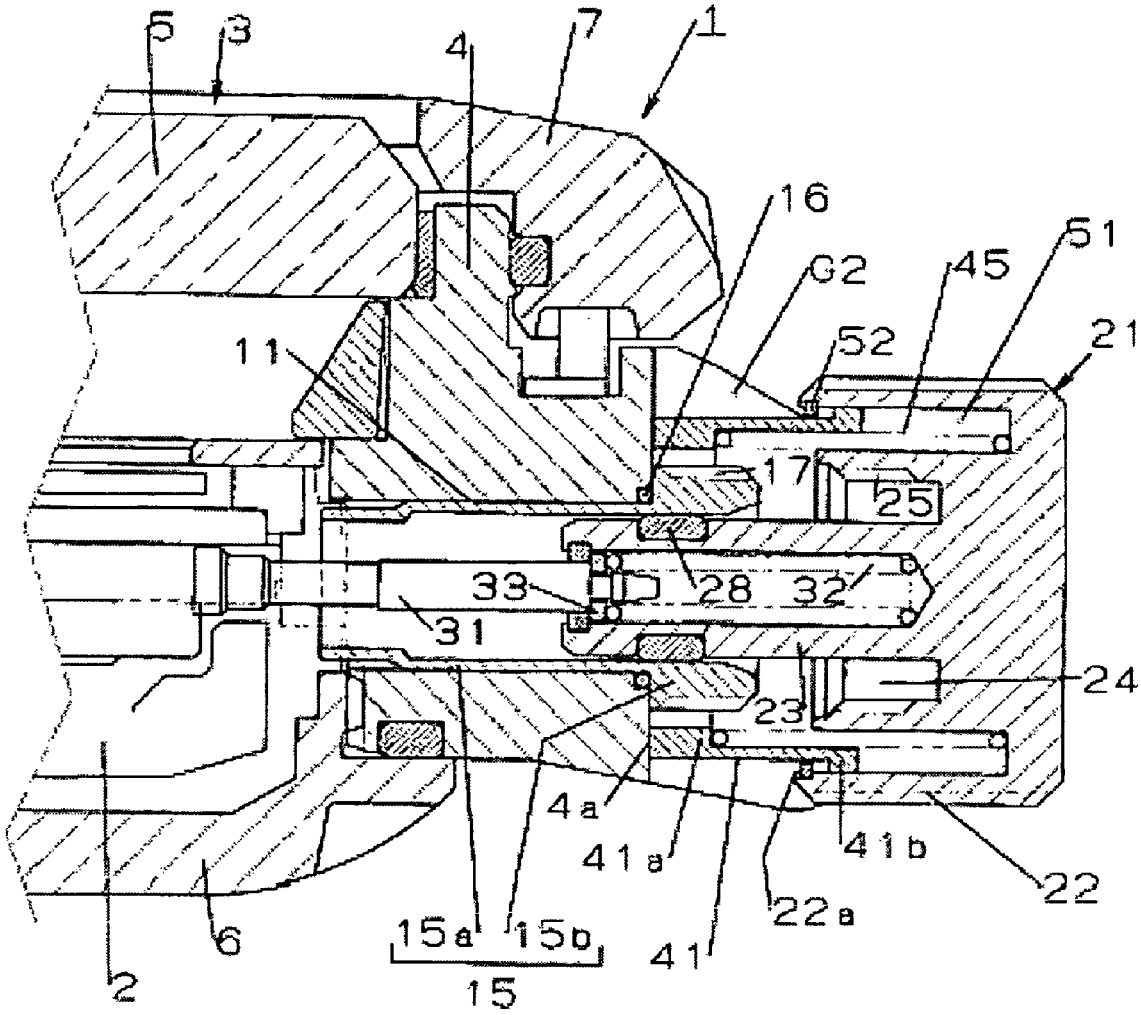
FIG. 7 is s sectional view in correspondence with FIG. 4 showing a state of drawing the crown of the diver's watch according to the second embodiment by two stages.

FIG. 5 through FIG. 7 show a second embodiment of the invention. The second embodiment is the same as the first embodiment except an item explained below. Therefore, constitutions the same as those of the first embodiment are attached with notations the same as those of the first embodiment and an explanation thereof will be omitted.

According to the second embodiment, the recess portion explained in the first embodiment is omitted, and the large diameter portion 15*b* of the hand setting stem pipe 15 is projected directly from the locking face 4*a* of the case body 4. Further, according to the second embodiment, the cover pipe 41 is integrated to the crown 21.

That is, the crown head 22 is formed with a pipe containing portion 51 in a shape of a circular ring having a diameter larger than that of the escape groove 24 and opened to the back face of the crown head 22. A stop ring 52 having a size of not closing a total of an opening of the pipe containing portion 51 is attached to an opening end portion of the pipe containing portion 51. The pipe containing portion 51 is contained with the cover pipe 41 movably in a direction of being brought in and out by passing the opening and contained with the coil spring 45. Both ends of the coil spring 45 are supported by a spring receive 41*a* of the cover pipe 41 and a depth face of the pipe containing portion 51, and the coil spring 45 is pinched therebetween in a compressed state to press the cover pipe 41 to the locking face 4*a*. The cover pipe 41 includes a stopper portion 41*b*. By catching the stopper portion 41*b* by the stop ring 52, the cover pipe 41 is prevented from being projected further from the back face of the crown head 22.

Further, although according to the second embodiment, the spring receive 41*a* is provided at the inner periphery of the cover pipe 41, the stopper portion 41*b* is provided at the outer periphery of the cover pipe 41, and therefore, the coil spring 45 is arranged on the inner side of the cover pipe 41, the stop ring 52 is provided on the outer side of the cover pipe 41, a relationship thereamong can also be reversed. That is, the spring receive 41*a* may be provided at the outer periphery of the cover pipe 41, the stopper portion 41*b* may be provided at the inner periphery of the cover pipe 41, the coil spring 45 is arranged on the outer side of the cover pipe 41, and the stop ring 52 may be provided on the inner side of the cover pipe 41. The second embodiment is the same as the first embodiment except the item explained above including a constitution not shown in FIG. 5 through FIG. 7.

A state in which the crown 21 is screw-locked in the second embodiment is shown in FIG. 5. In the state, the crown side screw portion 25 of the crown 21 is screwed to (brought in mesh with) the pipe side screw portion 17 of the hand setting stem pipe 15, and the engaging end face 22*a* of the crown 21 is brought into close contact with the locking face 4*a* of the case body 4. Thereby, the crown 21 is held in the screw-locked state.

Further, a total of the cover pipe 41 is pressed to inside of the pipe containing portion 51 of the crown 21 against the coil spring 45, and the cover pipe 41 is pinched by the depth face of the pipe containing portion 51 and the locking face 4*a* of the case body 4. Under the state, invasion of sand, dust or the like to the hand setting stem pipe 15 can be prevented by bringing the engaging end face 22*a* and the locking face 4*a* into close contact with each other as described above.

When, for example, date is set by operating the crown 21, date is set by first rotating the crown 21 in a direction of releasing the crown side screw portion 25 from being brought in mesh with the pipe side screw portion 17 to release the mesh, successively, drawing to operate the crown 21 to the one stage drawing position in the direction of being remote from the case body 4 along the axial direction, thereafter, operating to rotate the crown 21. The state is shown in FIG. 6.

When time is set, the gap G1 is produced between the locking face 4*a* of the case body 4 and the engaging end face 22*a* of the crown 21 by separating the crown 21 from the case body 4 as shown by FIG. 6 by operating to draw the crown 21 to the one stage drawing position. However, as the crown 21 is being remote from the case body 4 by the above-described operation, the cover pipe 41 is held to stay at a current position by the spring force of the coil spring 45. In other words, the cover pipe 41 is moved to the locking face 4*a* of the case body 4 relatively to the movement in the direction of drawing the crown 21, and therefore, the amount of projecting the cover pipe 41 from the back face of the crown 21 is increased and the state of bringing the cover pipe 41 into contact with the locking face 4*a* is maintained.

Thereby, although the gap G1 is formed between the engaging end face 22*a* of the crown head 22 and the locking face 4*a* by separating the crown head 22 from the locking face 4*a*, the state in which the cover pipe 41 arranged over the back face of the crown head 22 and the locking face 4*a* covers the hand setting stem pipe 15, accurately, a state of covering the large diameter portion 15*b* is maintained, and therefore, the pipe side screw portion 17 of the large diameter portion 15*b* is not exposed to the gap G1.

Therefore, when date is set as described above under a condition of a large amount of a foreign matter of dust and dirt or the like as in, for example, seashore, the foreign matter of sand or the like can be restrained from being brought to the pipe side screw portion 17 and the crown side screw portion 25 by passing the gap G1 by the cover pipe 41.

When, for example, time is set by operating the crown 21 further from the state of FIG. 6, time is set by operating to draw the crown 21 further to the two stages drawing position, thereafter, operating to rotate the crown 21. The state is shown in FIG. 7.

When time is set in this way, the gap G2 larger than the gap G1 is produced between the locking face 4*a* of the case body 4 and the engaging end face 22*a* of the crown 21 by further separating the crown 21 from the case body 4 as shown by FIG. 7 by operating to draw the crown 21 to the two stages drawing position. Also in this case, similar to the case of the one stage drawing described above, as the crown 21 is being remote from the case body 4, the amount of projecting the cover pipe 41 from the back face of the crown head 22 is further increased by the spring force of the coil spring 45, and therefore, the state in which the cover pipe 41 is brought into contact with the locking face 4*a* is maintained.

Even when the crown 21 is drawn maximally in this way, the state in which the cover pipe 41 is arranged over the back face of the crown head 22 and the locking face 4*a* is maintained, and the state in which the large diameter portion 15*b* of the hand setting stem pipe 15 is covered by the cover pipe 41 is continued. Therefore, the pipe side screw portion 17 of the large diameter portion 15*b* is not exposed to the gap G2. Therefore, when time is set as described above under the condition of the large amount of the foreign matter of dust and dirt or the like as in, for example, seashore or the like, the foreign matter of sand or the like can be restrained from being brought to the pipe side screw portion 17 and the crown side screw portion 25 by passing the gap G2 and the cover pipe 41.

After an adjustment of setting time or setting date as described above is carried out, in accordance with operating to rotate the crown 21 after pressing the crown 21 to the locking face 4*a*, the crown side screw portion 25 is screwed to the pipe side screw portion 17 and the crown 21 is maintained in the screw-locked state shown in FIG. 5.

Therefore, when the crown 21 is brought into the screw-locked state after the above-described adjustment, and in the crown operation thereafter, the foreign matter of sand or the like is not bit to between the pipe side screw portion 17 and the crown side screw portion 25. Therefore, the crown 21 is rotated smoothly for screwing the crown 21 to the hand setting stem pipe 15 and releasing the crown 21 from being brought in mesh with the hand setting stem pipe 15 and an excellent operating feeling can be achieved.

Further, even when the crown 21 is drawn to one stage or two stages drawing position as described above, the pipe side screw portion 17 is covered by the cover pipe 41 and is not exposed to between the locking face 4*a* and the engaging end face 22*a*. Therefore, when a user is going to draw to move the crown 21 by using the nail of the hand finger, the crown 21 can be smoothly drawn without hampering the operation of drawing the crown 21 by catching the nail tip by the pipe side screw portion 17 constituted by the male screw portion.

Further, according to the second embodiment, the cover pipe 41 and the coil spring 45 are integrated to the crown 21, and therefore, these can be dealt with as a unit and part control becomes easy. Along therewith, the recess portion for containing the cover pipe 41 is not needed in the case body 4, and therefore, it is preferable when the invention is carried out by attaching the unit to the timepiece exterior assembly 3 having the case body 4 having a thin thickness which is not suitable for providing the recess portion.

Figure 8:
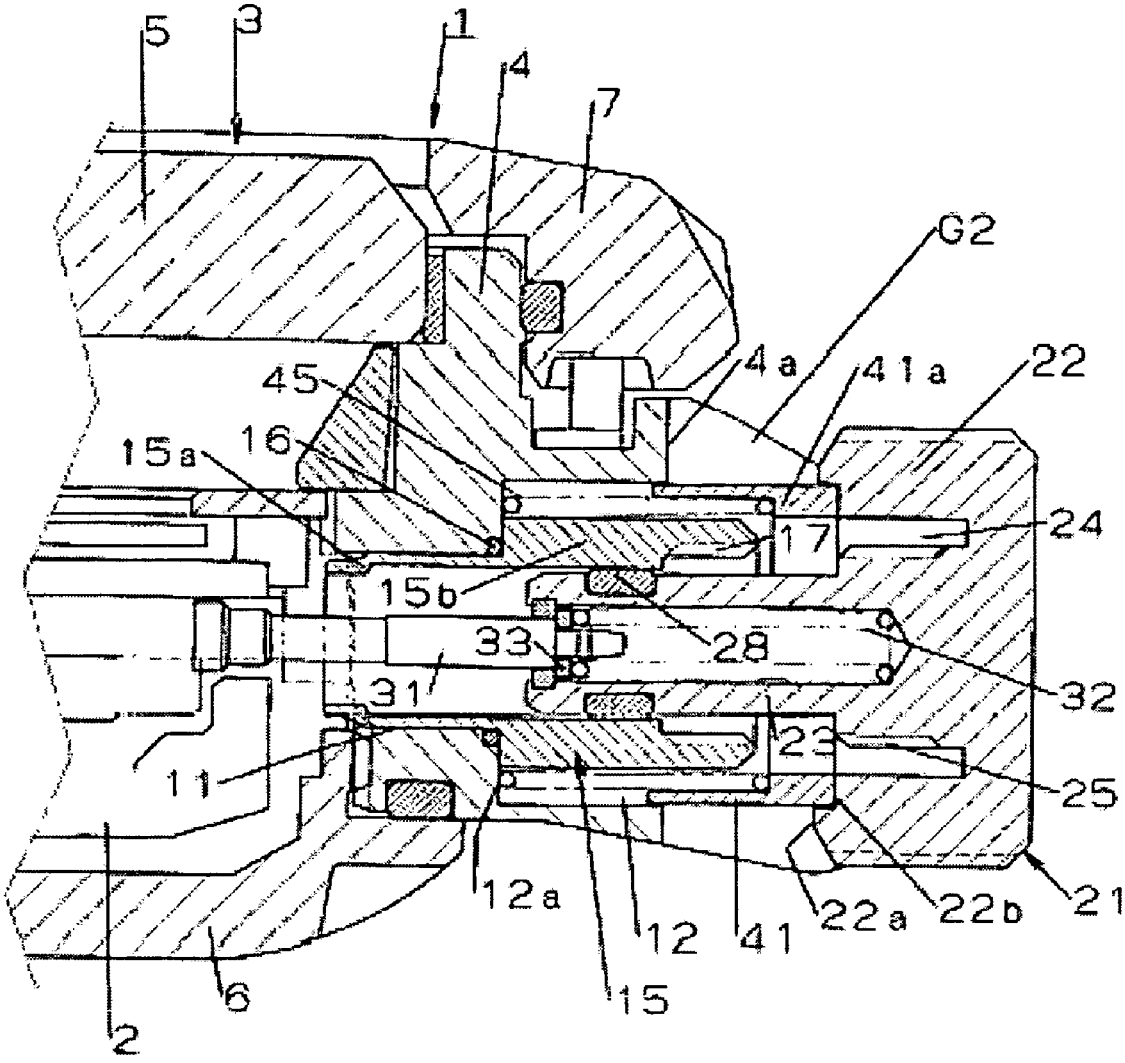
FIG. 8 is s sectional view in correspondence with FIG. 4 showing a state of drawing a crown of a diver's watch according to a third embodiment of the invention by two stages.

FIG. 8 shows a third embodiment of the invention. The third embodiment is the same as the first embodiment except an item explained below. Therefore, constitutions the same as those of the first embodiment are attached with notation the same as those of the first embodiment and an explanation thereof will be omitted.

According to the third embodiment, the pipe side screw portion 17 constituting the female screw portion is formed not at the outer periphery but the inner periphery of the front end portion of the large diameter portion 15*b* of the hand setting stem pipe 15. In accordance therewith, the crown side screw portion 25 constituting the male screw portion is formed at an outer periphery of a root portion of the crown cylinder 23 facing the escape groove 24 of the crown 21. The third embodiment is the same as the first embodiment except the item explained above including a constitution not shown in FIG. 8.

Therefore, also in the third embodiment, the problem of the invention can be resolved by reason explained already in the first embodiment.

Figure 9:
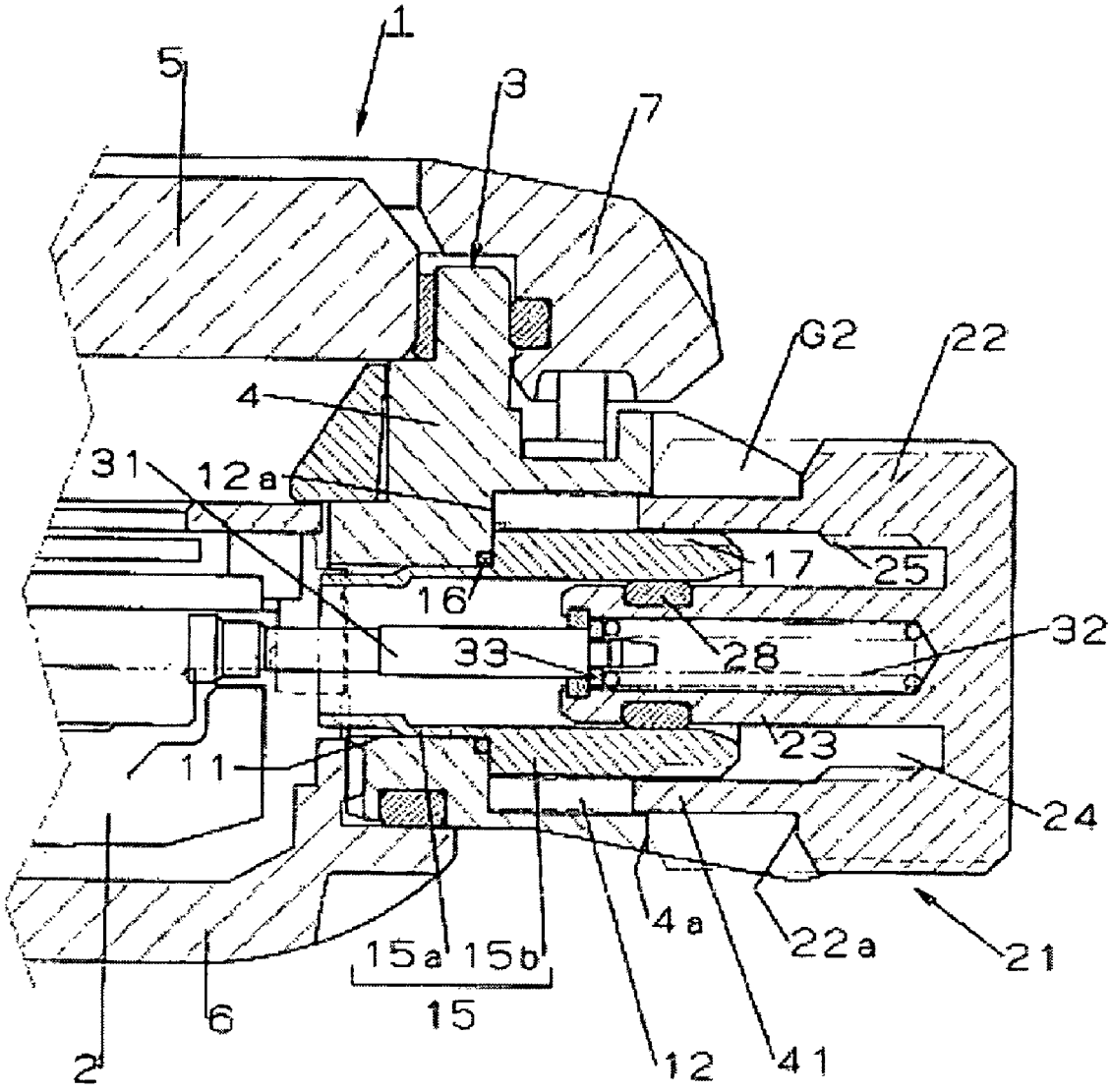
FIG. 9 is a sectional view in correspondence with FIG. 4 showing a state of drawing a crown of a diver's watch according to a fourth embodiment by two stages.

FIG. 9 shows a fourth embodiment of the invention. The fourth embodiment is the same as the first embodiment except an item explained below. Therefore, constitutions the same as those of the first embodiment are attached with notations the same as those of the first embodiment and an explanation thereof will be omitted.

According to the fourth embodiment, the cover pipe 41 is not a part separate from the crown 21 and is integrally projected to the back face of the crown head 22. The cover pipe 41 is surrounded by the engaging end face 22*a* by viewing the crown 21 from the back side. The cover pipe 41 is inserted to a space in a shape of a circular ring formed between the inner peripheral face of the recess portion 12 and the outer peripheral face of the large diameter portion 15*b*. Along therewith, the cover pipe 41 is provided with a length capable of maintaining a state of being inserted to the recess portion 12 even when the crown 21 is maximally drawn, that is, even when the crown 21 is arranged in the two stages drawing state as shown by FIG. 9. Further, in a state in which the crown 21 is screw-locked, as shown by a two-dotted chain line in FIG. 9, the total of the cover pipe 41 is inserted to inside of the recess portion 12. The fourth embodiment is the same as the first embodiment except the item explained above excluding a constitution not shown in FIG. 9.

Therefore, also according to the fourth embodiment, the problem of the invention can be resolved by reason already explained in the first embodiment. Further, the cover pipe 41 is moved integrally with the crown 21, and therefore, a coil spring for moving the cover pipe 41 separately from the crown 21 can be omitted, and therefore, it is excellent that the constitution is simple.

Further, the invention is not restricted by the diver's watch but is applicable also to a general wristwatch, pocket watch or the like which does not need a high degree of waterproof performance.

The invention claimed is:

1. A portable timepiece characterized in including:

a timepiece exterior assembly having a case body an outer peripheral portion of which is formed with a locking face and including a movement;

a hand setting stem pipe having a pipe side screw portion and fixed to the case body;

a crown having a crown cylinder inserted to inside of the hand setting stem pipe and a crown head integral with the crown cylinder and formed with a crown side screw portion attachably and detachably screwed to the pipe side screw portion, and an engaging end face brought into contact with and separated from the locking face at the crown head for operating the movement; and a cover pipe arranged more proximate to the crown cylinder than the engaging end face, covering the hand setting stem pipe and maintaining the covered state regardless of a movement in an axial direction of the crown.

2. The portable timepiece according to claim 1, characterized in that the case body is formed with a recess portion containing the hand setting stem pipe, the locking face is continuous to an opening end of the recess portion, the cover pipe is a part separate from the crown and contained in the recess portion, further, the cover pipe includes a spring receive at an inner periphery thereof, and a coil spring for pressing the cover pipe to the crown is provided between the spring receive and a depth face of the recess portion.

3. The portable timepiece according to claim 1, characterized in that the crown head is formed with a pipe containing portion opened to a side of the case body, the cover pipe is contained in the pipe containing portion, the cover pipe includes a spring receive, and a coil spring for pressing the cover pipe to the locking face is provided between the spring receive and a depth face of the pipe containing portion.

4. The portable timepiece according to claim 1, characterized in that the case body is formed with a recess portion containing the hand setting stem pipe, the locking face is continuous to an opening end of the recess portion, and the cover pipe is formed integrally with the crown head and inserted to the recess portion.

5. The portable timepiece according to claim 1, characterized in that the pipe side screw portion is formed by a male screw portion, and the pipe side screw portion is disposed to project to an outer side of the case body relative to the locking face.

* * * * *